United States Patent [19]

Young

[11] Patent Number: 4,680,937

[45] Date of Patent: Jul. 21, 1987

[54] AUTOMATIC FUEL TANK ANTI B.L.E.V.E. SAFETY APPARATUS AND SYSTEM

[76] Inventor: Colin G. Young, 1368 Glen Rutley Circle, Mississauga, Canada, L4X 1Z6

[21] Appl. No.: 835,761

[22] Filed: Mar. 3, 1986

[30] Foreign Application Priority Data

Mar. 5, 1985 [AU] Australia ..... PG9562

[51] Int. Cl.[4] ..... F17C 13/00

[52] U.S. Cl. ..... 62/54; 137/210; 169/68; 220/88 B; 239/127

[58] Field of Search ..... 220/88 R, 88 B; 169/66, 169/68; 239/126, 127; 62/45, 54, 50, 7; 137/210, 211

[56] References Cited

U.S. PATENT DOCUMENTS

| | | | |
|---|---|---|---|
| 2,545,640 | 3/1951 | Aitken | 169/68 |
| 2,706,527 | 4/1955 | Guljas et al. | 169/68 |
| 2,750,753 | 6/1956 | Armstrong | 137/210 |
| 2,790,307 | 4/1957 | Ayres | 62/54 |
| 2,976,695 | 3/1961 | Meade | 62/55 |
| 3,189,078 | 6/1965 | Davidsson | 62/51 |
| 3,191,395 | 6/1965 | Maher et al. | 62/54 |
| 3,246,479 | 4/1966 | Kelley | 62/54 |
| 3,967,633 | 7/1976 | Hallanger et al. | 137/202 |
| 3,970,098 | 7/1976 | Boswank et al. | 137/43 |

FOREIGN PATENT DOCUMENTS

| | | | |
|---|---|---|---|
| 1211724 | 3/1960 | France | 137/210 |

*Primary Examiner*—Ronald C. Capossela

*Attorney, Agent, or Firm*—Riches, McKenzie & Herbert

[57] ABSTRACT

A safety apparatus and system are disclosed which can be used in vessels for containing a liquifiable gas having a boiling point below the ambient temperature at atmospheric pressure. The apparatus and system provides an automatic method of cooling the vessel when the vessel is heated because of a fire in the region of the exterior of the vessel. The apparatus includes a pump to pump the liquified gas to a sprayer that sprays the liquified gas onto the vessel which is not in contact with the liquified gas. The pump is activated by movement of the vaporized gas that escapes through a pressure safety relief valve in the vessel.

7 Claims, 4 Drawing Figures

AUTOMATIC FUEL TANK ANTI B.L.E.V.E. SAFETY APPARATUS AND SYSTEM

BACKGROUND OF THE INVENTION

This invention relates to a safety apparatus and system to prevent B.L.E.V.E. (boiling liquid expanding vapour explosion) accidents in closed vessels containing fuels, such as propane or butane, or other liquifiable gases having a boiling point below the ambient temperature at atmospheric pressure, or other pressurized fluids. The vessels may be in a fixed installation, or may be mobile, such as a road or railway tanker.

Tragic accidents have occurred when such vessels have been engulfed in a fire. Typically, when a propane tank is in a fire, the temperature of the tank and fuel will rise, causing an increase in the pressure inside the tank, which will cause the safety relief valve to open, allowing some fuel to escape. Providing gaseous fuel is released (from the space above the surface of the liquid fuel), boiling will occur at the surface of the liquid due to the reduced pressure, thus lowering the temperature, and extracting heat from the tank into the liquid fuel. The pressure relief valve will close again when the tank pressure drops to below the design blow-off pressure (typically 250–375 p.s.i.). If sufficient heat is still applied to the tank, the relieving cycle will repeat.

Unfortunately, as the liquid level drops, there may be too long a heat conductance passage from the top of the tank to the area adjacent the liquid level that is at a safe, relatively cold temperature, that causes the top of the tank to reach a dangerously high temperature that weakens the tank material to the extent that the internal tank pressure causes the tank to rupture in a violent manner.

If liquid is discharged through the safety relief valve, a much higher amount of fuel (approximately 270 times) would be emitted, and a much smaller degree of internal cooling would be achieved, thus causing a much faster temperature rise of the tank.

SUMMARY OF THE INVENTION

The intent of the invention is to provide an automatic, self-contained system that will prevent the top portion of the tank from over-heating, whatever the orientation of the tank, as long as there is liquid in closed the tank, while ensuring that gaseous fuel is released from the pressure safety relief valve.

An automatic safety apparatus for use in a closed vessel for containing both liquified and vapourized gas of a liquifiable gas having a boiling point below the ambient temperature at atmospheric pressure, wherein the vessel has an interior and at least one pressure relief valve, comprising: a pumping means for pumping the liquified gas; first connecting means between the pumping means and the at least one relief valve to provide gaseous communication between the pumping means and the at least one relief valve; spraying means to be positioned in the portion of the interior of the vessel containing the vapourized gas and adapted to spray upwardly onto the vessel; a second connecting means for fluid passage between the pumping means and the spraying means; wherein the pumping means is caused to pump the liquified gas through the second connecting means to the spraying means by movement of the vapourized gas which passes through the pumping means either before or after passing through the relief valve.

DETAILED DESCRIPTION OF THE PREFERRED EMBODIMENTS

Figure 1:
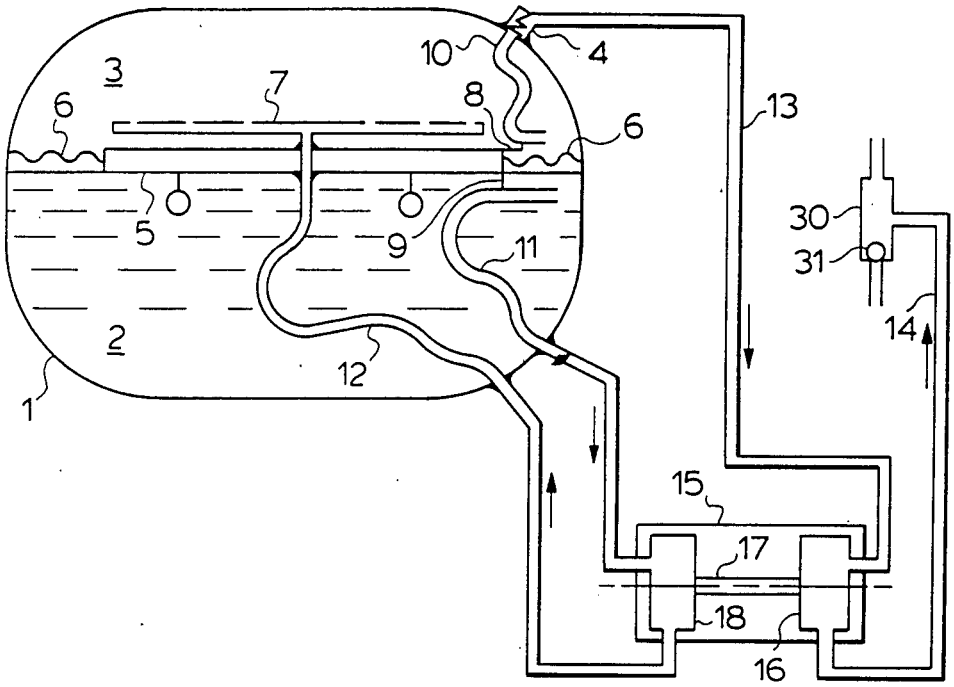
FIG. 1 is a schematic diagram of an embodiment of the invention.

The operation of the invention will be described with the aid of FIG. 1 which shows a vessel 1 containing liquid fuel 2 and gaseous fuel 3, fitted with a pressure safety relief valve 4 communicating with the gaseous fuel 3. The relief valve need not be fitted in the perimeter of the vessel but can be positioned in any of the relevant connecting means as described below. Not shown are the inlet valve, outlet valve, fixed level valve, and contents gauge.

A self-righting weighted float 5 is secured by flexible members 6 to prevent impacting the vessel 1, regardless of its motion or orientation. The float 5 contains a spray assembly 7, with its outlets arranged in a general vertically upward direction, and its inlet connected to the flexible tubular member 12. The float 5 has a support 8 to ensure that the flexible tubular member 10, which is secured to the relief valve 4 in FIG. 1 or the pumping device in FIG. 4, always has its inlet in the gaseous portion of the fuel 3. The float 5 also has a support 9 to ensure that the flexible tubular member 11 always has its inlet in the liquid portion of the fuel 2. The members 10, 11 and 12 are of suitable length, strength and configuration to avoid over-stressing during any particular movement of the float 5.

The system includes a pumping device 15, which may be either inside (FIG. 4) or outside (FIG. 1) the vessel 1; normally, for ease of plumbing and for better protection, it would be positioned inside the vessel 1, typically mounted on the float 5 or otherwise fixed within the vessel 1.

In the preferred embodiment shown in FIG. 1, the pumping device 15 is in the form of a rotary turbocharger, comprising a fluidic motor 16 driving a fluidic pump 18 by means of a shaft 17. The motor 16 has its inlet connected to tubular member 13, and its outlet connected to a discharge valve 30 by means of tubular member 14. The discharge valve 30 typically incorporates a number of outlets and ball valves 31 to ensure that only the most vertically upward outlet is open.

The pump 18 has its inlet connected to tubular member 11, and its outlet connected to tubular member 12. The discharge valve 30 may include a self-reseating cover to prevent rain or other materials from entering it.

During normal conditions, both the motor 16 and the pump 18 would have no differential pressure between the respective inlets and outlets, hence there would be no component or fuel movement. Should sufficient heat be applied to the vessel 1 to cause the internal pressure to rise above the setting of the pressure safety relief valve 4, gaseous fuel 3 will discharge through member 13, motor 16, member 14, and discharge valve 30. The differential pressure across the motor 16 will cause the motor 16 to rotate, which in turn will cause the pump 18 to rotate. A differential pressure will be created across the pump 18, causing liquid fuel 2 to pass through members 11 and 12, out through the spray assembly 7 to impinge on the upper portion of the vessel 1, thus cooling it. In order to provide maximum cooling, the entrance to tubular member 11 would be positioned as close as possible to the shell of the vessel 1, just below the surface of the liquid.

Figure 2:
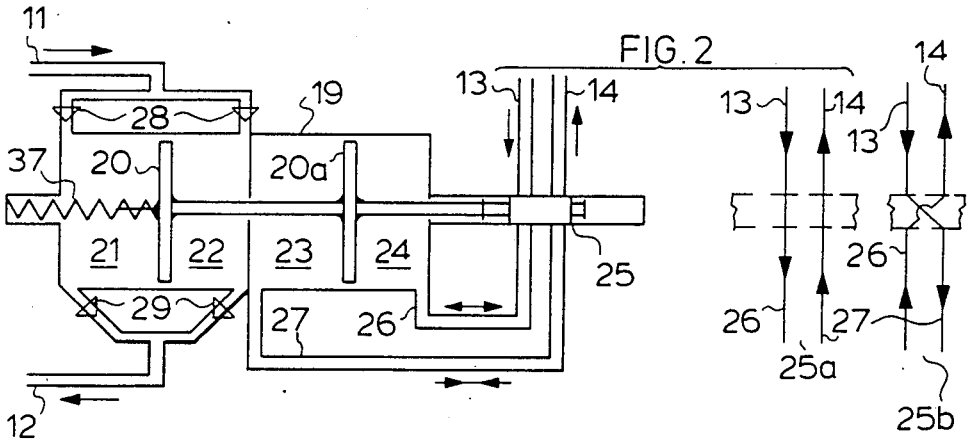
FIG. 2 is a schematic diagram of part of an other embodiment of the invention.

FIG. 2 shows another typical variant of the pumping device 15. Designated 15*a*, the pumping device is in the form of a twin double-acting piston assembly, acting in a reciprocating manner, and comprises a partitioned cylinder 19 and twin pistons 20 and 20*a*, which control a four-way valve assembly 25. Tubular members 11, 12, 13 and 14 are as shown in FIG. 1. As shown, the right piston 20*a* acts as a fluid motor, moving between chambers 23 and 24, which are respectively connected by tubular members 27 and 26 to the change-over valve 25. The left piston 20 acts as a fluid pump, moving between chambers 21 and 22. Tubular members 11 and 12 are connected to chambers 21 and 22 by means of one-way back-check valves 28 and 29 respectively.

The pistons 20 and 20*a* are biased to the right end of the twin cylinder 19 by means of the spring 31, so that chambers 22 and 24 are at the smallest volume, and chambers 21 and 23 are at the largest volume. In this position, the valve 25 is as shown in 25*a*, where tubular members 13 and 26 are connected together, and tubular members 14 and 27 are connected together.

If the relief valve 4 discharges, gaseous fuel 3 will pass through tubular members 13 and 26, causing the piston 20*a* to move to the left, thus discharging the fuel in chamber 23 through tubular members 27 and 14 and discharge valve 30 into the atmosphere. The piston 20 will also move to the left, thus discharging the fuel in chamber 21 through tubular member 12 and spray assembly 7. At the same time, liquid fuel 2 will be forced through tubular member 11 into chamber 22.

When the pistons 20 and 20*a* reach the end of the stroke, the valve 25 will move to the change-over position shown in 25*b*, thereby reversing the cycle; when the pistons 20 and 20*a* reach the end of the stroke to the right, the valve 25 will again revert to position 25*a*. The change-over is arranged to ensure that the pistons 20 and 20*a* remain at the end of a stroke when the relief valve 4 closes again.

When the vessel 1 is installed in a fixed situation, with no possibility of ever becoming inverted, the float 5 and spray 7 would be replaced by a fixed spray unit. In all cases, the size of all components would be related to the capacity or surface area of the vessel 1. A pre-set bypass valve may be installed between the inlet and outlet of the motor 16, and/or pump 18.

An alternate embodiment may replace the floating self-righting spray assembly with a multiple of fixed spray units having outlets pointing in various directions, with gravity valves arranged so that only the generally upward pointing sprays would be open.

Figure 3:
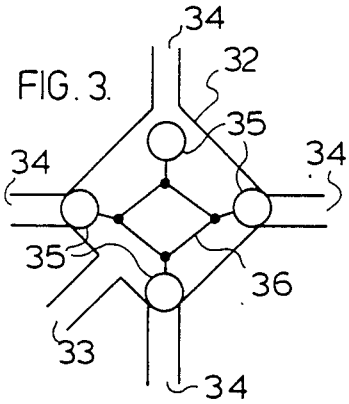
FIG. 3 is a schematic diagram of an upward-opening gravity valve.

FIG. 3 shows a gravity valve assembly that ensures that only the most vertically upward outlet is open. In the invention, normally four outlets would be adequate, although more or less outlets may be used. The assembly consists of a housing 32 having an inlet 33 and outlets 34, normally equally spaced radially, with an equal number of valves 35 capable of sealing the outlets 34, and connected by a hinges parallelogram link assembly 36. The link assembly 36 is sized so that it is impossible for all valves 35 to be closed. Gravity and in-coming fluid pressure will ensure that the upper-most valve 35 will not close its mating outlet 34.

Figure 4:
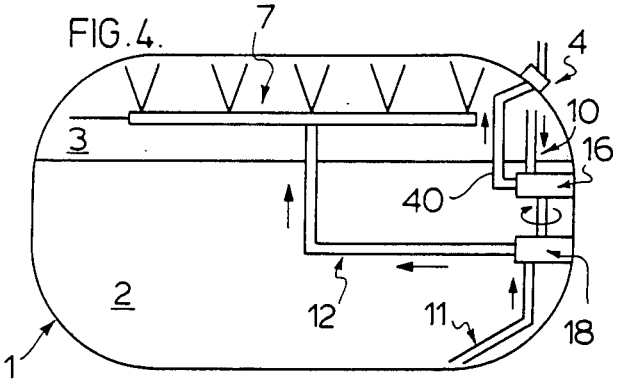
FIG. 4 is a schematic diagram of an other embodiment of the invention.

In the preferred embodiment of FIG. 4, the apparatus is much the same as disclosed for FIG. 1. However, the input to the motor 16 is directly through tubing 10, the end of which is exposed to the vapourized gas 3 inside the vessel 1. The outlet of the pump 16 is connected by flexible tubing 40 to the relief valve 4. Thus, in this embodiment, the vapourized gas passes through the motor 16 before it escapes through the relief valve 4 to atmosphere.

The principles of the invention have been described above, but it is realized that a person skilled in the art could devise function variants and equivalents not described, but which would fall within the scope and intent of the invention.

I claim:

1. An automatic safety apparatus for use in a closed vessel for containing both liquified and vapourized gas of a liquifiable gas having a boiling point below the ambient temperature at atmospheric pressure, wherein the vessel has an interior and at least one pressure relief valve comprising:

a pumping means for pumping the liquified gas;

first connecting means between the pumping means and the at least one relief valve to provide gaseous communication between the pumping means and the at least one relief valve;

spraying means to be positioned in the portion of the interior of the vessel containing the vapourized gas and adapted to spray upwardly onto the vessel;

a second connecting means for fluid passage between the pumping means and the spraying means;

wherein the pumping means is caused to pump the liquified gas through the second connecting means to the spraying means by movement of the vapourized gas which passes through the pumping means either before or after passing through the relief valve.

2. A safety apparatus as defined in claim 1 wherein said at least one relief valve is in gaseous communication with the vapourized gas in the vessel;

the pumping means comprises a fluidic motor capable of driving a fluidic pump by means of a shaft;

wherein the fluidic motor is driven by movement of the vapourized gas which passes from the interior of the vessel thrugh the relief valve and then to an inlet of the fluidic motor through the first connecting means which comprises a flexible tubing member;

wherein an outlet of the fluidic motor is in gaseous communication with atmosphere;

wherein an inlet of the fluidic pump is in liquid communication with the liquified gas in the vessel; and wherein an outlet of the fluidic pump is in liquid communication with the spraying means by way of the second connecting means which comprises a flexible tubing member.

3. A safety apparatus as defined in claim 2 wherein the spraying means is floatable in the liquified gas.

4. A safety apparatus as defined in claim 1 wherein the pumping means comprises a twin, double-acting piston assembly comprising a partitioned cylinder and twin pistons which control a four-way valve.

5. A safety apparatus as defined in claim 4 wherein the spraying means is floatable in the liquified gas.

6. A safety apparatus as defined in claim 1 wherein said at least one relief valve is in gaseous communication with atmosphere;

the pumping means is positioned within the vessel and comprises a fluidic motor capable of driving a fluidic pump by means of a shaft;

wherein the fluidic motor is driven by movement of the vapourized gas which passes from the interior of the vessel to an inlet of the fluidic motor through a flexible tubing member;

wherein an outlet of the fluidic pump is in gaseous communication with the relief valve by means of the first connecting means which comprises a flexible tubing member;

wherein an inlet of the fluidic pump is in fluid communication with the liquified gas in the vessel; and wherein an outlet of the fluidic pump is in fluid communication with the spraying means by way of the second connecting means which comprises a flexible tubing member.

7. A safety apparatus as defined in claim 6 wherein the spraying means is floatable in the liquified gas.

* * * * *